US007007865B2

(12) United States Patent
Dodd

(10) Patent No.: US 7,007,865 B2
(45) Date of Patent: Mar. 7, 2006

(54) SELF-ADJUSTING NOZZLE

(75) Inventor: Rex A. Dodd, 2401 Neely, Midland, TX (US) 79705

(73) Assignee: Rex A. Dodd, Midland, TX (US)

( * ) Notice: Subject to any disclaimer, the term of this patent is extended or adjusted under 35 U.S.C. 154(b) by 85 days.

(21) Appl. No.: 10/640,990

(22) Filed: Aug. 14, 2003

(65) Prior Publication Data

US 2005/0035224 A1 Feb. 17, 2005

(51) Int. Cl.
*B05B 3/00* (2006.01)
*B05B 3/08* (2006.01)
*B05B 1/30* (2006.01)

(52) U.S. Cl. ..... 239/225.1; 239/232; 239/246; 239/249; 239/569; 239/583; 239/554

(58) Field of Classification Search ..... 239/225.1, 239/232, 246, 249, 569, 583, 554; 166/222; 7/191
See application file for complete search history.

(56) References Cited

U.S. PATENT DOCUMENTS

| | | | | |
|---|---|---|---|---|
| 1,230,666 | A | | 6/1917 | Carden |
| 1,333,390 | A | | 3/1920 | Dickinson |
| 2,466,182 | A | | 4/1949 | Peeps |
| 2,661,065 | A | | 12/1953 | McCoy |
| 2,933,259 | A | | 4/1960 | Raskin |
| 3,730,269 | A | | 5/1973 | Galle |
| 4,031,971 | A | | 6/1977 | Miller |
| 4,758,169 | A | * | 7/1988 | Steiger ..... 239/96 |
| 4,806,172 | A | | 2/1989 | Adaci et al. |
| 4,991,667 | A | | 2/1991 | Wilkes, Jr. et al. |
| 5,135,051 | A | | 8/1992 | Facteau et al. |
| 5,165,438 | A | | 11/1992 | Facteau et al. |
| 5,423,483 | A | | 6/1995 | Schwade |
| 5,603,378 | A | * | 2/1997 | Alford ..... 166/222 |
| 5,732,885 | A | | 3/1998 | Huffman |
| 5,836,393 | A | * | 11/1998 | Johnson ..... 166/308.1 |
| 6,029,746 | A | | 2/2000 | Dodd |
| 6,470,980 | B1 | | 10/2002 | Dodd |

OTHER PUBLICATIONS

Product Sales Bulletin for Tornado Nozzle Coiled Tubing, Apr. 27, 2001.
International Search Report, May 5, 2005.

* cited by examiner

*Primary Examiner*—Davis Hwu
(74) *Attorney, Agent, or Firm*—Locke Liddell & Sapp, LLP

(57) ABSTRACT

A self-adjusting nozzle for use in injecting pressurized, and optionally pulsating, fluid into a well bore or other conduit for the purpose of cleaning out the bore or conduit, the nozzle having slidably engaged mandrel and tool tip sections, each with an axial bore, and the tool tip having a plurality of axially and circumferentially spaced discharge ports communicating with the axial bores, the mandrel being able to reciprocate inside the tool tip without operator intervention in response to obstructions encountered ahead of, around or behind the nozzle as it enters or leaves the well bore or conduit, thereby sequentially blocking or unblocking some of the discharge ports to direct more of the pressurized fluid against the obstruction.

15 Claims, 3 Drawing Sheets

SELF-ADJUSTING NOZZLE

BACKGROUND OF THE INVENTION

1. Field of the Invention

This invention relates to a tool useful for cleaning out bore holes and tubular conduits, and particularly to the cleanout and stimulation of bore holes in deviated or horizontal subterranean wells.

2. Description of Related Art

The use of jetting nozzles attached to tubing or coiled tubing for cleaning out and removing fill material and debris, often compacted, from bore holes and tubulars is well known. With most of the prior art nozzles, pressurized or pulsating jets of water or other fluids such as chemicals, solvents, acids, nitrogen, or the like, are discharged through a fixed pattern of channels and orifices disposed in nozzles. More recently, Halliburton has introduced its Hydro Jet tool and BJ Services has introduced its Tornado coiled tubing nozzle for use in cleanout operations. Both tools are said to be particularly effective for cleanouts of deviated and horizontal wells.

Both tools are believed to utilize sleeves disposed inside the nozzles to selectively close off jets and open other jets during different phases of a cleanout operation. When the tool is being advanced forwardly through a well bore, the sleeve is pinned in a position where the forwardly and radially directed jets are open. When the tool is to be withdrawn, a heavy ball is first dropped down the tubing to impact the sleeve, shear or dislocate the pin, and shift the sleeve to a second position where the forwardly directed jets are closed and the rearwardly directed back jets are opened. The back jets assist in sweeping away sediment that may have settled around the tubing behind the nozzle during entry into the well bore.

Many times, the cleanout operation can be conducted more effectively and efficiently if one can cycle the tool repeatedly through forwardly and backwardly directed movements. Unfortunately, with the prior art nozzles, there has not been a readily available means for cycling the sleeve back to the position where the forwardly facing jets are open and the back jets are blocked without tripping the tool to remove the ball and re-pin the sleeve. Commercially available nozzles are typically unable to vary the fluid discharge pattern or velocity down hole by contact with an obstruction when moving either in or out of the hole. Accordingly, a jet nozzle is needed that can be cycled through sequences of forward and backward motion without having to manually shift some part of the nozzle or trip the tool to reset an internal sleeve or other such mechanical device.

SUMMARY OF THE INVENTION

A self-adjusting nozzle is disclosed herein that can be run on tubing or coiled tubing and can be cycled forwardly and backwardly inside a well bore to dislodge and sweep sand or other debris from the hole. The subject tool can be used in many different applications such as pipe, screen, open hole, cased hole or in other tubular conduits, and with many different fluids, including without limitation water, chemicals, solvents, acids, nitrogen, and the like. The self-adjusting nozzle can be run in combination with other devices, including pulsating subs, indexing tools, knuckle joints and other bottom hole equipment normally used with standard velocity tools. Applications for the tool exist in the oil and gas industry and in the water production industry, as well as with other industrial processes and equipment.

According to a preferred embodiment of the invention, the self-adjusting nozzle comprises a mandrel with an axial bore and a tool tip having a larger diameter bore and a plurality of jets or outlet ports through which a fluid pumped downwardly through the mandrel is discharged to effect cleaning of a well bore or tubular conduit. The lower end of the mandrel is confined within the tool tip by a packing nut and slidably engages the tool tip bore. O-ring seals prevent fluid leakage between the mandrel and tool tip. The range of travel of the mandrel inside the tool tip is desirably sufficient to permit the mandrel to sequentially block and unblock various jets as the mandrel reciprocates inside the tool tip in response to the forward and backward movement of the nozzle in a well bore or conduit. As used herein, the term "self-adjusting" refers to the capability of the subject nozzle to repeatedly block and unblock discharge ports in the tool tip in response to the type, amount and position of debris encountered inside a well bore or conduit without the necessity of tripping the tool to manually reset one or more elements inside the nozzle. By varying the number of ports through which fluid is discharged from the tool tip, the self-adjusting nozzle of the invention can also vary the velocity of the discharged fluid.

BRIEF DESCRIPTION OF THE DRAWINGS

The apparatus of two preferred embodiments of the invention is further described and explained in relation to the following drawings in which.

DESCRIPTION OF THE PREFERRED EMBODIMENTS

Figure 1:
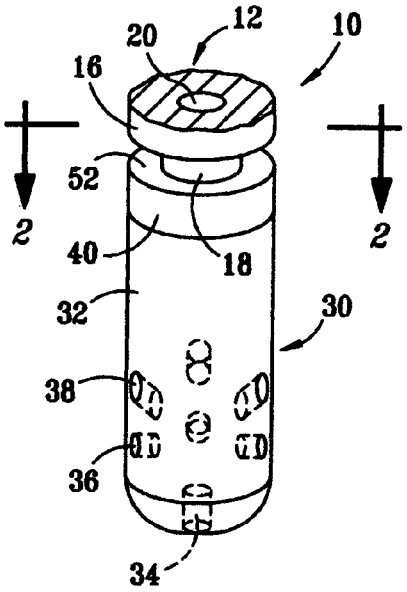
FIG. 1 is a front perspective view of a preferred embodiment of the self-adjusting nozzle of the invention, with the top pin connector portion broken away.
Figure 3:
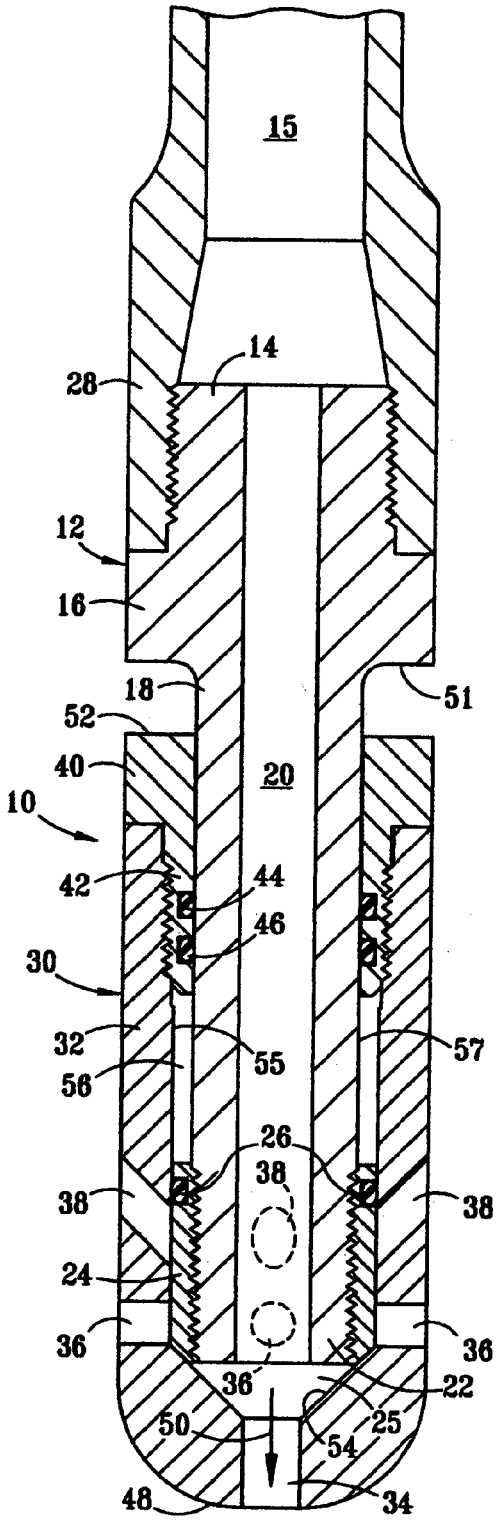
FIG. 3 is a cross-sectional front elevation view of the self-adjusting nozzle of the invention as installed beneath a section of tubing.

Referring to FIGS. 1 and 3, self-adjusting nozzle 10 comprises mandrel 12 and tool tip 30. Mandrel 12 is shown with the top connector portion broken away for reasons discussed below in relation to FIG. 3. Mandrel 12 further comprises top flange 16, reduced-diameter lower section 18 and centrally disposed axial bore 20. Tool tip 30 further comprises body 32 having a substantially closed nose end 48 and a plurality of axially and circumferentially spaced discharge ports 34, 36, 38, which are discussed in greater detail below in relation to FIGS. 4–6 Because jets of pressurized fluid are discharged through one or more of the ports during operation of self-adjusting nozzle 10, the discharge ports are themselves sometimes referred to as "jets." The discharge ports can be spaced apart and oriented in any desired direction. Preferably, at least one discharge port 34 is directed axially out the substantially closed end of tool tip 30, at least one discharge port 36 is directed radially outward (substantially perpendicular to the axial direction), and at least one discharge port 38 is directed obliquely backward or rearward from the substantially closed end. Most preferably, a plurality of circumferentially spaced discharge ports 34, 36, 38 are directed in each such orientation to provide cleaning action around the entire circumference of body 32. If desired, discharge ports having the same or various configurations and orientations can be arranged in a spiral array or other patterns around the periphery of body 32. In general, forwardly directed jets aid in cleaning out and removing debris from those portions of a well bore or conduit that are ahead of nozzle 10, radial jets clean and remove debris from around nozzle 10, and back jets clean and remove debris that has settled behind nozzle 10 as it moves ahead. Coincidentally with removing debris from a well bore, self-adjusting nozzle 10 can also stimulate production from a surrounding formation.

Referring to FIG. 3, self-adjusting nozzle 10 is shown with a mandrel 12 having an upper connector portion comprising threaded pin end 14 to provide mating engagement with the cooperatively threaded box end of tubing section 28 having axial bore 15. It should be understood that nozzle 10 can be run on either tubing or coiled tubing, and the type of connector disposed at the top of mandrel 12 should be suitable for use with the connector disposed at the bottom end of such tubing, or at the bottom of another sub or tool disposed between the tubing and nozzle. For example, a pulsating sub can be utilized between tubing segment 28 and mandrel 12, in which case the top connector portion of mandrel 12 should cooperatively engage the lower end of the pulsating sub, whether a pin end, box end, or other. Axial bore 15 of tubing 28 should nevertheless communicate either directly or through another intermediate device with axial bore 20 of self-adjusting nozzle 10 to insure that pressurized fluid is available for discharge through discharge ports 34, 36, 38 of tool tip 30.

Reduced-diameter section 18 of mandrel 12 extends downwardly from top flange 16 opposite pin end 14 and is insertable into close sliding engagement with a centrally disposed axial bore in packing nut 40 of tool tip 30. During make-up of nozzle 10 prior to assembling nozzle 10 to tubing segment 28, reduced-diameter section 18 of mandrel 12 is desirably inserted through packing nut 40 before reduced-diameter end portion 42 of packing nut 40 is threaded into body 32. Sealing rings 44, 46, preferably O-rings disposed in axially spaced annular grooves on the cylindrical inside surface of packing nut 40, retard fluid leakage between mandrel 12 and packing nut 40 during use. Following insertion of the lower end of reduced-diameter section 18 of mandrel 12 through packing nut 40, and while packing nut 40 is still free from body 32, mandrel retainer ring 24 is desirably threaded onto the lower end of reduce-diameter section 18 of mandrel 12 to prevent mandrel 12 from subsequently sliding upwardly past packing nut 40 and out of engagement with packing nut 40. Only after retainer ring 24 is installed below packing nut 40 is the assembly of self-adjusting nozzle 10 completed by threading end 42 of packing nut 40 into engagement with the open top end of body 32. At least one sealing ring 26 is desirably disposed on the outside surface of mandrel retainer ring 24 between discharge ports 34, 36, 38 and packing nut 40 to reduce the likelihood of fluid leakage into annulus 56 above mandrel retainer ring 24 after packing nut 40 is threaded into engagement with body 32. Once the lower end of mandrel 12 and packing nut 40 are installed in body 32 of tool tip 30, an annulus 56 defined by cylindrical inside wall 55 of body 32 and cylindrical outside wall 57 of reduced-diameter section 18 is created between lower end 42 of packing nut 40 and the top of mandrel retainer ring 24. The axial distance between the two when mandrel 12 is bottomed out against lower inside surface 54 of body 32 determines the maximum range of travel between the slidably engaged mandrel 12 and tool tip 30.

As shown in FIG. 3, when reduced-diameter section 18 of mandrel 12 bottoms out inside tool tip 30, the lower end of mandrel retainer ring 24 desirably abuts against inclined wall 54 of tool tip 30 before annular shoulder 51 of mandrel 12 abuts annular shoulder 52 of packing nut 40, which cannot not occur anyway with the parts made as shown because of the radius between shoulder 51 and the outside wall of reduced-diameter section 18. The beveled lower end of mandrel retainer ring 24 is desirably inclined so as to cooperate with inclined wall 54 to substantially block pressurized fluid traveling downward through axial bore 20 of mandrel 12 into axial bore 25 of tool tip 30 from flowing upwardly into radial discharge ports 36 rather than outwardly through front discharge port 34 as indicated by arrow 50. Although not shown in FIG. 3, nose end 48 of tool tip 30 is preferably fluted to prevent front discharge port 34 from completely plugging off if self-adjusting nozzle 10 is set down at the bottom of the hole.

Figure 2:
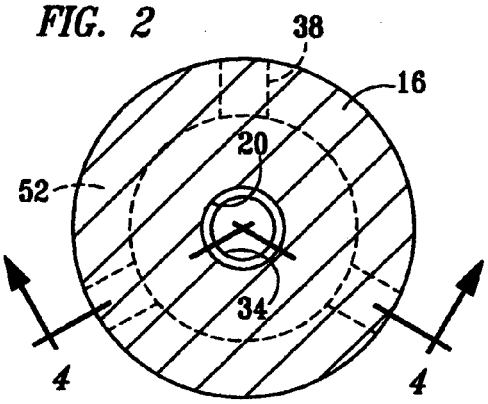
FIG. 2 is an enlarged, cross-sectional view taken along line 2—2 of FIG. 1.
Figure 4:
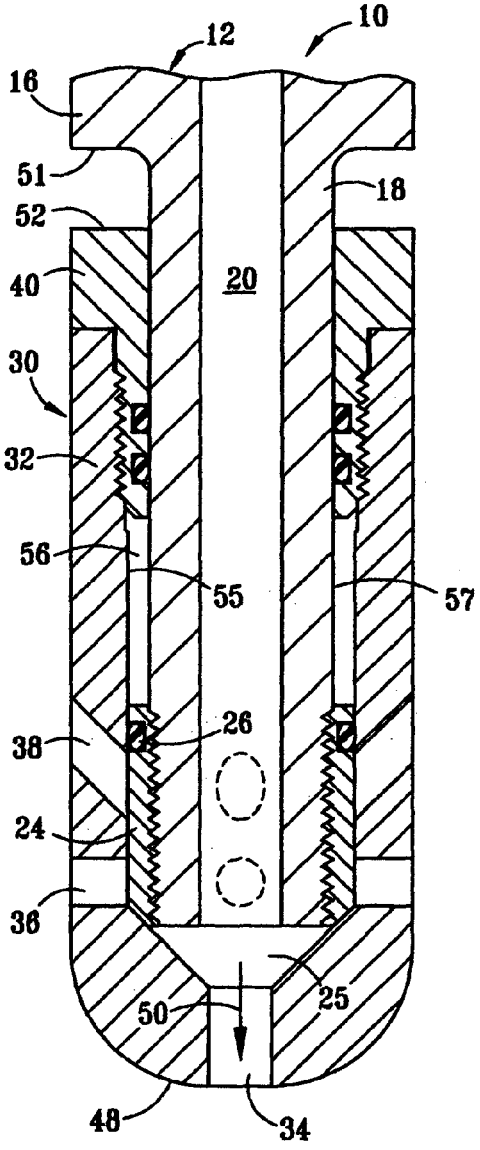
FIG. 4 is a cross-sectional view taken along 4—4 of FIG. 2, showing the mandrel in its fully collapsed position relative to the tool tip.

The operation of self-adjusting nozzle 10 of the invention is further described and explained in relation to FIGS. 2 and 4–7, all of which embody the same nozzle 10 but are further enlarged from the views depicted in FIGS. 1 and 3 to better illustrate the internal structure of tool tip 30 relative to the position of mandrel 12. Referring to FIGS. 2 and 4, mandrel 12 of nozzle 10 is depicted in its most downwardly or forwardly (depending upon the orientation of nozzle 10) extending position relative to tool tip 30, as in FIG. 3, with mandrel retainer ring 24 abutting against the inclined, interior wall of nose end 48. In this position, a flow of pressurized fluid introduced downwardly through axial bore 20 of mandrel 12 is effectively blocked by mandrel retainer ring 24 from being discharged through radial discharge ports 36 and rearwardly directed, oblique discharge ports 38 of tool tip 30. Instead, the entire flow is directed axially outward through axial discharge port 34 in nose end 48 of tool tip 30 as indicated by arrow 50. FIG. 4 illustrates the nozzle and flow configuration that exists when nose end 48 of tool tip 30 encounters an obstruction in a bore hole or conduit, and is best suited for directed the full force of the pressurized fluid against that obstruction. It will be appreciated, however, upon reading this disclosure that substantially closed nose end 48 of tool tip 30 can similarly comprise an array of discharge ports rather than just a single axial port, in which case some or all of such discharge ports can be directed obliquely, rather than axially, forward. In the latter case, it will be appreciated that the cumulative function of such ports is still to clean out or remove any obstruction located ahead of nozzle 10. It should be noted that in this preferred embodiment, mandrel retainer ring 24 "bottoms out" inside axial bore 25 of tool tip 30 before annular shoulder 51 of mandrel flange 16 reaches facing annular shoulder 52 of packing nut 40.

Figure 5:
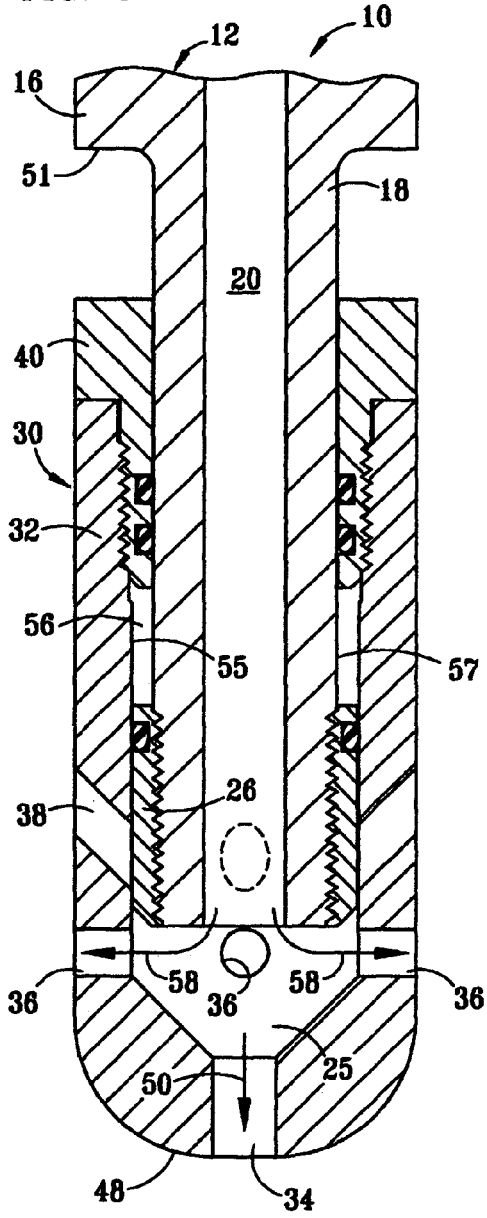
FIG. 5 depicts the same structure as FIG. 4 but showing the mandrel partially withdrawn relative to the tool tip, with the radially directed jets unblocked.

FIG. 5 depicts an intermediate position of nozzle 10 in which elongate slidable section 18 of mandrel 12 is shifted upward (or backward, for horizontal wells) from the position shown in FIG. 4, so that pressurized fluid can flow through axial discharge port 34 as shown by arrow 50 and also through radial discharge ports 36 as shown by arrows 58. Although the three circumferentially spaced, radially directed discharge ports 36 are not spaced apart axially, it is understood that they can likewise be disposed in a spiral array whereby they are both circumferentially and axially spaced-apart, in which case the radial ports will be sequentially unblocked as the distance between nose end 48 and mandrel 12 increases. As mandrel 12 moves upwardly (or backwardly, in a horizontal well) in relation to nose end 48 of tool tip 30, the length of annulus 56 between inside wall 55 of body 32 of tool tip 30 and outside wall 57 of elongate cylindrical slide section 18 of mandrel 12 is shortened as the top of retainer ring 24 approaches the bottom of packing nut 40.

Figure 6:
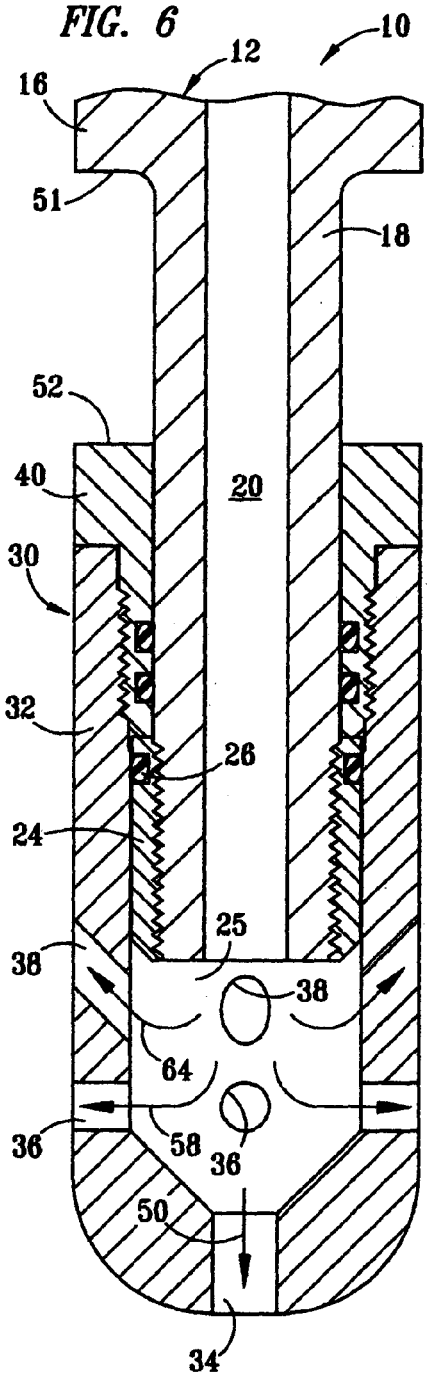
FIG. 6 depicts the same structure as FIGS. 4 and 5, but showing the mandrel fully retracted relative to the tool tip, with both the radially directed jets and oblique, back jets unblocked.

FIG. 6 illustrates the position of mandrel 12 relative to tool tip 30 whenever mandrel 12 is at the top end of its range of travel inside axial bore 25. This position is reached, for example, when nozzle 10 is being withdrawn from a well bore or conduit in which it is deployed. In this position, the top of mandrel retainer ring 24 abuts the bottom of packing nut 40 and rearwardly or backwardly directed oblique discharge ports 38 are also unblocked. In this configuration, pressurized fluid entering nozzle 10 through axial bore 20 of mandrel 12 is discharged first into axial bore 25 of tool tip 30 and then into and through axial bore 34 as shown by arrow 50, through radial ports 36 as shown by arrows 58, and through oblique, rearward ports 38 (thereby creating back jets) as shown by arrows 64. It is understood here that, as described above in relation to radial discharge ports 36 in FIG. 5, either radial discharge ports 36 or backwardly directed oblique ports 38, or both, can be spaced apart both circumferentially and axially if desired. With ports 36, 38 unblocked, most of the flow from bore 20 of mandrel 12 will exit through those ports, meaning that most of the force is directed toward removing debris from around or behind nozzle 10. Such debris accumulations behind nozzle 10 can occur, for example, as material dislodged by the axial jet discharged through port 34 is carried upward and around nozzle 10 whenever nozzle 10 is moving into a well bore or conduit.

Figure 7:
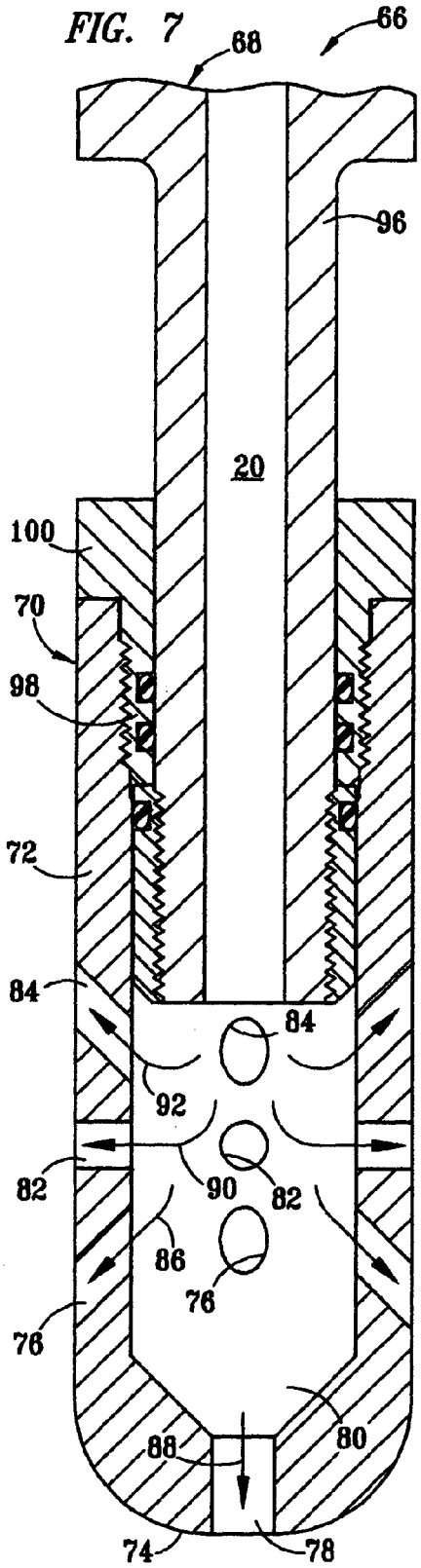
FIG. 7 is a cross-sectional front elevation view of an alternate embodiment of the self-adjusting nozzle of the invention wherein oblique, forwardly directed jets are provided between the front jet and the radial jets.

FIG. 7 depicts another embodiment of the invention wherein, like in FIG. 6, elongate slide section 86 of mandrel 68 of nozzle 66 is fully retracted relative to tool tip 70, unblocking all discharge ports emanating through body wall 72 and nose end 74 of tool tip 70. In the position shown, the mandrel retainer ring again abuts the bottom of lower threaded section 98 of packing nut 100. In this embodiment, however, a plurality of oblique, forwardly directed discharge ports 76 are provided in addition to axial discharge port 78, radially directed discharge ports 82 and oblique, rearwardly directed discharge ports 84. Here, as before, pressurized fluid introduced into tool tip 30 through bore 75 flows downwardly into axial bore 80 of tool tip 70 and then outwardly as shown by arrows 86, 88, 90, 92. Because more axially spaced jets are provided, the length of body 72 of tool tip 70 and the length of elongate slide section 96 of mandrel 66 are longer than shown in FIGS. 4–6

A significant benefit of the self-adjusting nozzle 10, 66 disclosed herein in relation to those that are otherwise known is the ability of elongate slide sections 18, 96 to reciprocate relative to tool tip 30, 70, respectively, in response to obstructions encountered in front of, around or behind the nozzle regardless of the axial direction in which the nozzle is moving. As mandrel 12, 66 reciprocates, fluid discharge ports are sequentially blocked or unblocked without tripping the tool or the need for other operator intervention. Furthermore, the nozzle of the invention can be cycled between advancing movement and withdrawing movement as many times as needed without withdrawing the nozzle from the hole.

Although threaded connections are disclosed herein as being preferred for use in releasably connecting the various elements of nozzle 10, 66, and for attaching the nozzle to a supply conduit, typically a tubing string or coiled tubing, it will be appreciated by those of skill in the art that other similarly effective means can likewise be used within the scope of the invention. Other alterations and modifications of the disclosed invention will likewise become apparent to those of ordinary skill upon reading this disclosure and it is intended that the invention disclosed herein be limited only by the broadest interpretation of the appended claims to which the inventor is legally entitled.

We claim:

1. A self-adjusting nozzle insertable into a conduit or well bore for use in discharging a pressurized fluid into the conduit or well bore, the nozzle comprising:

a tool tip having an elongated, substantially cylindrical sidewall with an open end and a substantially closed end, a first axial bore with a first diameter, an internally threaded upper section in the first axial bore, at least one discharge port extending through the substantially closed end, a plurality of axially and circumferentially spaced discharge ports extending through the sidewall below the threaded upper section, and a packing nut threadedly engageable with the threaded upper section of the tool tip, the packing nut having a second axial bore with a second diameter that is less than the first diameter; and a mandrel having a third axial bore with a third diameter that is smaller than the second diameter, a connector section attachable to a tubular member through which the pressurized fluid is provided to the nozzle, a flange section disposed distally of the connector section and having an outer diameter larger than the second axial bore, and an elongate slide section disposed distally of the flange section and having an externally threaded lower end, the slide section being insertable through the packing nut and slidably engageable with the second axial bore and insertable into the first axial bore when the packing nut is threaded into engagement with the threaded upper section of the tool tip; and a retainer ring slidably engageable with the first axial bore, the retainer ring being threadedly engageable with the externally threaded lower end of the elongate slide section of the mandrel after insertion of the elongate slide section through the packing nut before the packing nut is threaded into engagement with the threaded upper section of the tool tip.

2. The nozzle of claim 1 wherein at least one fluid seal member is provided between the retainer ring and the first axial bore.

3. The nozzle of claim 1 wherein at least one fluid seal member is provided between the elongate slide member and the second axial bore.

4. The nozzle of claim 1 wherein the tool tip comprises a plurality of radially directed discharge ports.

5. The nozzle of claim 1 wherein the tool tip comprises a plurality of forwardly directed discharge ports.

6. The nozzle of claim 5 wherein at least one of the forwardly directed discharge ports is oblique.

7. The nozzle of claim 1 wherein the tool tip comprises a plurality of oblique, rearwardly directed discharge ports.

8. The nozzle of claim 1 wherein the elongate slide section of the mandrel has an axial range of travel sufficient to substantially block all discharge ports except the discharge port extending through the substantially closed end.

9. The nozzle of claim 1 wherein the elongate slide section of the mandrel has an axial range of travel sufficient to unblock all discharge ports.

10. The nozzle of claim 1 wherein the elongate slide section sequentially blocks axially spaced discharge ports as the elongate slide section slides toward the substantially closed end of the tool tip.

11. The nozzle of claim 1 wherein the elongate slide section sequentially unblocks axially spaced discharge ports as the elongate slide section slides away from the substantially closed end of the tool tip.

12. A nozzle for discharging pressurized fluid, the nozzle comprising:

a mandrel having an elongated end and an axial bore;

a tool tip having a second axial bore of larger diameter than the axial bore of the mandrel, the tool tip comprising a plurality of axially spaced fluid discharge ports;

the mandrel being insertable into sliding engagement with the tool tip and having a range of travel inside the second axial bore that sequentially blocks and unblocks the axially spaced fluid discharge ports as the mandrel is reciprocated axially inside the tool tip;

wherein the tool tip comprises a packing nut that cooperates with the mandrel to prevent the mandrel from slidably disengaging the tool tip; and wherein the packing nut threadedly engages the second axial bore.

13. A nozzle for discharging pressurized fluid, the nozzle comprising:

a mandrel having an elongated end and an axial bore;

a tool tip having a second axial bore of larger diameter than the axial bore of the mandrel, the tool tip comprising a plurality of axially spaced fluid discharge ports;

the mandrel being insertable into sliding engagement with the tool tip and having a range of travel inside the second axial bore that sequentially blocks and unblocks the axially spaced fluid discharge ports as the mandrel is reciprocated axially inside the tool tip;

wherein the mandrel comprises a retainer ring that cooperates with the tool tip to prevent the mandrel from slidably disengaging the tool tip; and wherein the retainer ring threadedly engages the mandrel.

14. A nozzle for discharging pressurized fluid, the nozzle comprising:

a mandrel having an elongated end and an axial bore;

a tool tip having a second axial bore of larger diameter than the axial bore of the mandrel, the tool tip comprising a plurality of axially spaced fluid discharge ports;

the mandrel being insertable into sliding engagement with the tool tip and having a range of travel inside the second axial bore that sequentially blocks and unblocks the axially spaced fluid discharge ports as the mandrel is reciprocated axially inside the tool tip;

wherein the tool tip comprises a packing nut that cooperates with the mandrel to prevent the mandrel from slidably disengaging the tool tip; and wherein the packing nut comprises a third axial bore with which the mandrel is slidably engaged.

15. A nozzle for discharging pressurized fluid, the nozzle comprising:

a mandrel having an elongated end and an axial bore;

a tool tip having a second axial bore of larger diameter than the axial bore of the mandrel, the tool tip comprising a plurality of axially spaced fluid discharge ports;

the mandrel being insertable into sliding engagement with the tool tip and having a range of travel inside the second axial bore that sequentially blocks and unblocks the axially spaced fluid discharge ports as the mandrel is reciprocated axially inside the tool tip;

wherein the mandrel comprises a retainer ring that cooperates with the tool tip to prevent the mandrel from slidably disengaging the tool tip; and wherein the retainer ring comprises a cylindrical outside surface that slidably engages the second axial bore.

* * * * *